United States Patent [19]

Nguyen et al.

[11] Patent Number: 4,940,992

[45] Date of Patent: Jul. 10, 1990

[54] BALANCED LOW PROFILE HYBRID ANTENNA

[76] Inventors: Tuan K. Nguyen, 22699 SW 53rd Ave., Boca Raton, Fla. 33433; Quirino Balzano, 1120 NW 77th Ave., Plantation, Fla. 33322

[21] Appl. No.: 395,174

[22] Filed: Aug. 18, 1989

Related U.S. Application Data

[63] Continuation of Ser. No. 179,707, Apr. 11, 1988, abandoned.

[51] Int. Cl.[5] ..... H01Q 9/26

[52] U.S. Cl. ..... 343/803; 343/702; 343/741

[58] Field of Search ..... 343/702, 741, 742, 743, 343/744, 803

[56] References Cited

U.S. PATENT DOCUMENTS

| | | | |
|---|---|---|---|
| 2,515,816 | 7/1950 | Zindel, Jr. | 343/702 |
| 2,866,195 | 12/1958 | Powlison | 343/803 |
| 2,888,676 | 5/1959 | Spindler | 343/744 |
| 3,736,591 | 5/1973 | Rennels et al. | 343/702 |

OTHER PUBLICATIONS

"Small Antennas", by Harold A. Wheeler published in the IEEE Transactions on Antennas and Propagation, vol. AP-23, No. 4, Jul., 1975, pp. 462-469.

"Personal Radio Antennas" by N. H. Shepard and W. G. Chaney of G. E., Lynchburg, Va., pp. 23-31, source of the publication is unknown.

*Primary Examiner*—William L. Sikes

*Assistant Examiner*—Robert E. Wise

[57] ABSTRACT

An antenna for a low profile portable communications receiver is described. The antenna comprises a conductor formed into a single turn loop having a first set of parallel opposed sides one quarter wavelength or less in length at the operating frequency and a second set of parallel opposed sides, substantially shorter than the first set of sides. The loop terminates in connection tabs symmetrically about the midpoint of one of the first set of sides for connection to a receiver. A dielectric core is interposed within the loop, substantially filling the loop. With the core within the loop, the loop also functions as a halfwave electric dipole thereby providing an antenna responsive to both the magnetic and electric fields of an electromagnetic wave.

11 Claims, 4 Drawing Sheets

-PRIOR ART-

BALANCED LOW PROFILE HYBRID ANTENNA

This is a continuation of application Ser. No. 179,707, filed Apr. 11, 1988, now abandoned.

FIELD OF THE INVENTION

This invention relates to antennas for miniature portable communications receivers and more particularly to a low profile hybrid antenna having balanced magnetic and electric field response characteristics.

BACKGROUND OF THE INVENTION

Antennas used in miniature portable communications receivers, such as pagers, have generally been magnetic loop antennas optimized only to respond to the H-field component of an incident electromagnetic wave. Such prior art magnetic loop antennas were manufactured with either round or flat conductors formed as single or multiple loop antennas, with or without magnetic materials, such as a ferrite core. The choice of design, with or without the core, was primarily dictated by the frequency of operation and the available space within the receiver housing to accommodate the antenna. Since these miniature portable communications receivers were generally worn on the body, such as in a shirt pocket or clipped to the belt, the loop was generally tuned so as to couple to the magnetic fields which encircle a human body in an electromagnetic field, thereby enhancing the sensitivity of the receiver. While such a portable communications receiver benefit from the "body enhancement" effect, this benefit was often at the expense of degraded sensitivity when the receiver was removed from the body, or in a free field mode of operation as would occur when the portable communications receiver was placed on a table or desk.

While the prior art antenna designs have provided adequate performance in portable communications receivers having a substantial loop cross-sectional area, these designs have proved to be inadequate in portable communication receiver designs having extremely low profiles, such as encountered in housings for thin sheet-like receivers as in a "credit card" style pager. There is a need for an antenna that can be simply manufactured and provides excellent performance in such a low profile portable communications receiver.

BRIEF SUMMARY OF THE INVENTION

It is therefore an object of the present invention to provide a low profile antenna providing good sensitivity.

It is a further object of the present invention to provide a low profile antenna operable over a wide range of frequencies.

It is yet another object of the present invention to provide a low profile antenna providing good sensitivity on and off the body.

It is a further object of the present invention to provide a low profile antenna optimizing both magnetic and electric field response characteristics.

These and other objects which will become apparent are provided in an antenna for a low profile portable communications receiver. The antenna comprises a conductor formed into a single turn loop having a first set of parallel opposed sides and a second set of parallel opposed sides, the first set of sides being substantially longer than the second set of sides. The loop terminates in connection tabs symmetrically about the midpoint of the first set of sides for connection to a receiver. A dielectric core is interposed within the loop, substantially filling the loop. With the core within the loop, the loop also functions as a half-wave electric dipole, thereby providing an low profile antenna responsive to both the magnetic and electric fields of an electromagnetic wave.

BRIEF DESCRIPTION OF THE DRAWINGS

The features of the invention which are believed to be novel are set forth with particularity in the appended claims. The invention itself, together with its further objects and advantages thereof, may be best understood by reference to the following description when taken in conjunction with the accompanying drawings, in the several figures of which like reference numerals identify identical elements, in which:

DESCRIPTION OF A PREFERRED EMBODIMENT

Figure 1:
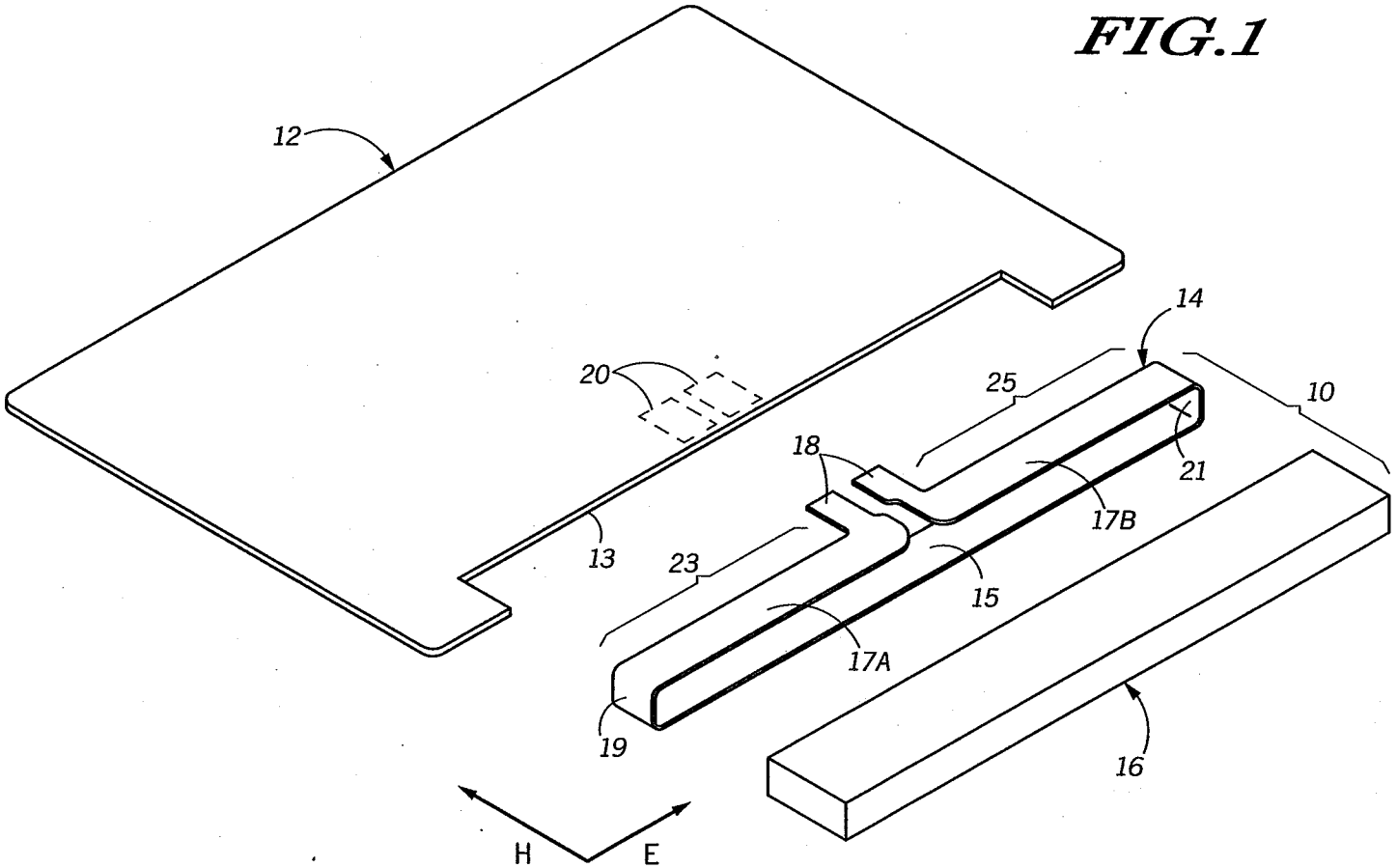
FIG. 1 is an isometric drawing showing a preferred embodiment of the present invention.

With respect to the figures, FIGS. 1–5 illustrate a construction and performance of a preferred embodiment of the present invention, a low profile hybrid antenna providing a balanced response characteristics to the magnetic and electric field components of an electromagnetic wave. Reference is directed to FIG. 1 which shows an isometric view of the preferred embodiment of the present invention, a low profile antenna 10 capable of operating efficiently over a wide frequency range from 150 MHz to 1000 MHz. As shown, antenna 10 comprises a core 16 and a conductor 14. Conductor 14 is formed into a single turn loop having substantially horizontal parallel opposed sides 15 and 17A–B and substantially vertical parallel opposed sides 19 and 21. Side 17A–B terminates in integral connection tabs 18 which are located symmetrically about the midpoint of side 17, thereby providing a center fed antenna configuration. This single turn loop functions in a conventional manner as a magnetic dipole with the long dimension of the loop typically one-quarter wavelength or less in length at the operation frequency. However, as shown, the loop geometry is somewhat unconventional in that it has an extremely low profile, as is required in a thin sheet-like receiver, and that the connection to the antenna is at the midpoint of the loop, rather then at an endpoint of the loop, as has been typically done previously. The choice of the center fed configuration is not arbitrary, but rather is based on the fact that a substantial improvement in antenna sensitivity is obtained over the end fed configuration when the aspect ratio of the sides of the loop, i.e. the horizontally positioned sides 15 and 17 are substantially longer than the vertically positioned sides 19 and 21 as will be discussed with reference to FIG. 5.

Considering FIG. 1 in greater detail, conductor 14, with integral connection tabs 18, can be formed in a suitable manner, such as by a stamping from a flat sheet of thin conductive material, or sheet metal, such as copper or beryllium copper. A round conductor can be used. However, as will be appreciated by one of ordinary skill in the art, the flat conductor allows a thinner profile antenna while maintaining the lowest resistance. Conductor 14 may be suitably plated, such as with copper, nickel and tin to provide a durable surface which is easily soldered to mating conductors 20 which provide connection to a receiver and which are shown for illustrative purposes as being on printed circuit board (P.C.B.) 12. It should be noted the configuration of connecting tabs 18 is not critical to the performance of antenna 10, and that other configurations for connection, such as soldering or welding separate wires or conductors to antenna 10 would work equally as well.

The core 16, having a substantially rectangular cross section normal to the plane of the loop formed by conductor 14, is interposed within conductor 14 between sides 15 and 17 and also between 19 and 21. Core 16 may also have chamfered or radiused edges to accommodate mounting or other physical requirements without affecting the performance of antenna 10. Core 16 is made from a dielectric material, which provides several functions with respect to the performance of antenna 10. The first function provided by core 16 is minimizing the detuning, i.e. the shift of tuned center frequency, of antenna 10 when the receiver is moved close to the body. By minimizing the detuning of the antenna, the antenna can be tuned for optimum performance either on the body or off the body. The resultant sensitivity loss due to operation of the receiver in a condition other than for which the antenna was optimally tuned, would then not adversely effect the antenna sensitivity. The second function performed by core 16 is to provide a means of optimizing the impedance of antenna 10. Such optimization makes matching of the antenna to a receiver easier than for a conventional loop antenna. The third and most important function of core 16 is to optimize the electric field response of the antenna, thereby enhancing the overall antenna performance. This is accomplished by the generation of a half wavelength electric dipole having arms 23 and 25 symmetrical about connection tabs 18. The electric dipole response can be optimized for any frequency within the 150 MHz to 1000 MHz operating frequency range by properly selecting the length of the arms 23 and 25 of the dipole and the relative dielectric constant of core 16. These functions will be described in greater detail in the specification.

While not shown in FIG. 1, a thin adhesive film may be applied to conductor 14 so as to securely position core 16 within conductor 14.

Reference is now directed to FIG. 2 which shows a top view of FIG. 1 illustrating further details for the construction of the preferred embodiment of the present invention. As shown in FIG. 2A, the core 16 is positioned inside conductor 14, forming antenna 10. Antenna 10 is further positioned within a cutout 13 in P.C.B. 12. P.C.B. 12, along with antenna 10, are positioned inside a housing 11. The housing 11 can be composed of a pliable material such as plastic, polycarbonate, or LEXAN. The cutout 13 minimizes the thickness required for housing 11 as shown in FIG. 2B and further limits any interaction of antenna 10 with the receiver. Connection tabs 18 are formed so as to allow antenna 10 to be positioned within cutout 13 while allowing contact to printed circuit conductors 20, as shown in FIG. 2C. It will be appreciated by one of ordinary skill in the art that antenna 10 may be rotated horizontally 180 degrees, thereby bringing connection tabs 18 to P.C.B. 12 from the top without affecting the antenna performance.

Figure 2A:
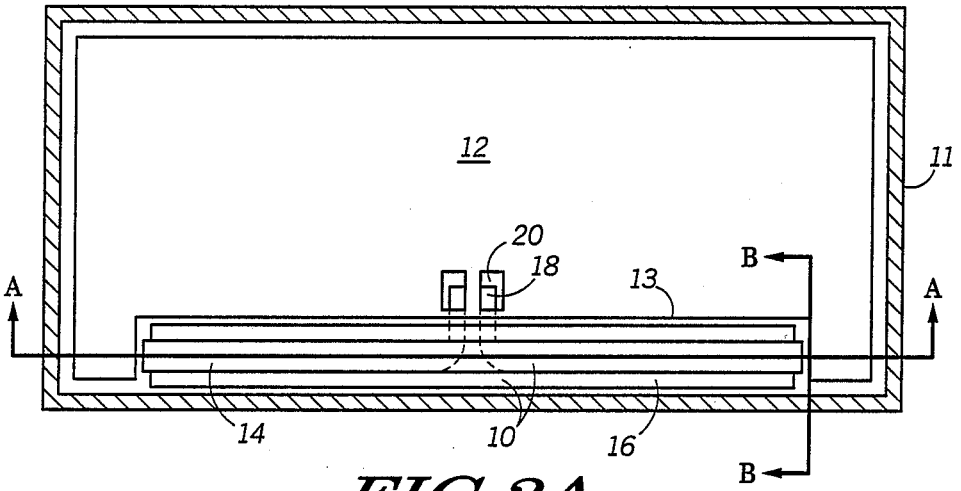
FIG. 2A is a further diagram showing the preferred embodiment of the present invention.
Figure 2B:
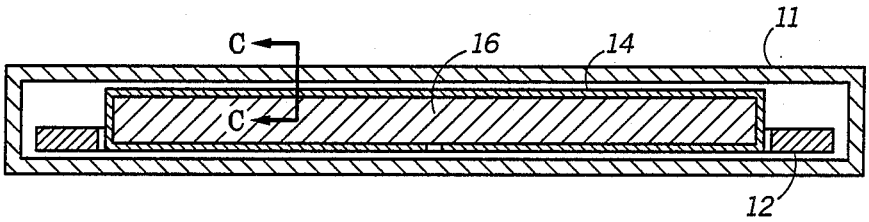
FIG. 2B is a sectional view taken along line A—A of FIG. 2A.
Figure 2C:
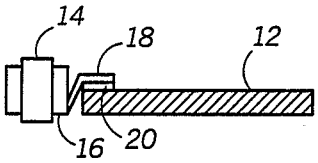
FIG. 2C is a sectional view taken along line B—B of FIG. 2A.
Figure 2D:
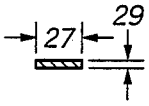
FIG. 2D is a sectional view taken through conductor along line C—C of FIG. 2B.

As shown in FIG. 2D conductor 14 has a width 27 of 0.118 inches and a thickness 29 of 0.010 inches after being suitably plated. As shown in FIG. 2B, the internal dimension the loop formed by conductor 14 is 0.143 inches (sides 19 or 21) by 2.6 inches (side 15), providing an aspect ratio of approximately 18 for the sides of the loop. A dielectric core 16 of approximately the same dimension as the loop is positioned within the loop. Dielectric core 16 has a cross section measuring 0.118 inches by 0.245 inches, thus extending beyond the edges of conductor 14. Dielectric core 16 is a high dielectric constant material, such as Alsimag 192 manufactured by General Electric, having a relative dielectric constant, $\epsilon$, of approximately 100. The loop length and core dielectric constant chosen provide a half-wave electric dipole at the 280 MHz operating frequency, and results in an antenna impedance of approximately 10 ohms. It will be appreciated by one of ordinary skill in the art that as the operating frequency is increased, the dimensions of the rectangular loop antenna constructed in view of the present invention would decrease, given a constant relative dielectric constant core. Furthermore, a variety of dielectric materials having relative dielectric constants between 3 and 250 are available to allow tailoring the size of the antenna. The size of the antenna at any fixed operating frequency would increase as lower relative dielectric constant cores are used, in order to maintain equivalent antenna sensitivities. Furthermore the width of the core need not extend beyond the width of conductor 14 when a core having a relative dielectric constant greater than $\epsilon=3$ is used. To prevent fringing, the width of core 16 has to be at least the width of conductor 14. With the dielectric core in place, relative electric fields are substantially confined between the sides of the loop, as occurs in a parallel strip line, and in so doing, this greatly reduces the interaction generally noted when the receiver is placed close to the body, as previously described.

Figure 3:
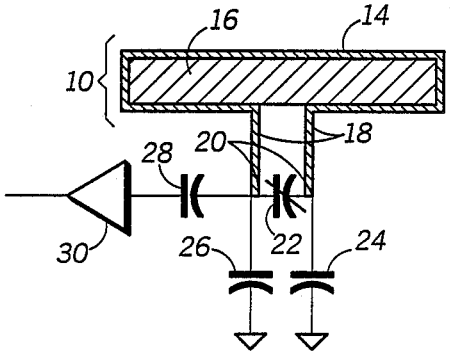
FIG. 3 is a schematic diagram showing an electrical connection of the preferred embodiment of the present invention to a receiver.

For purposes of explanation, an antenna operating at a frequency of 280 MHz will be used to describe the circuit of FIG. 3 as well as the performance characteristics shown in FIGS. 4 and 5. However, it is important to note that antenna 10 operates in the range 200 MHz to 1000 MHz with approximately the same characteristics. FIG. 3 shows the electrical schematic for the circuitry to tune and match antenna 10 to the receiver. The operating frequency of antenna 10 is determined by variable capacitor 22 which couples across the output terminals, or connecting tabs 18, of antenna 10 and capacitor 24 which couples from a first output terminal of antenna 10 and ground. Variable capacitor 22 is used to tune the exact center operating frequency. For a 280 MHz operating frequency, variable capacitor 22 ranges from 2 to 10 picofarads. Capacitor 24 will range from 1 to 3 picofarads depending upon the actual antenna impedance which varies depending upon the relative dielectric constant of core 16. Capacitor 26 which couples between the second output terminal of antenna 10 and ground, and capacitor 28 which couples between the second output terminal of antenna 10 and the input of RF amplifier 30 are used to match the output impedance of antenna 10 to the input impedance of RF amplifier 30 in a manner well known to one of ordinary skill in the art.

Figure 4A:
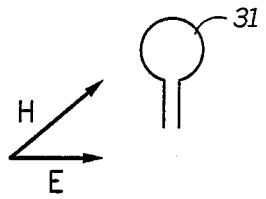
FIG. 4 is a table comparing the performance of the preferred embodiment of the present invention to other conventional antenna geometries.
Figure 4B:
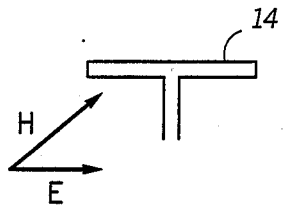
Figure 4C:
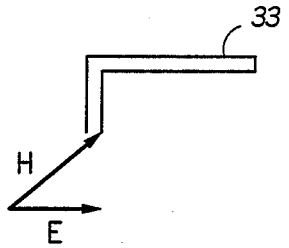

As previously described, the center fed rectangular loop configuration was found to be better than an end fed rectangular loop configuration. Table 1 below compares the performance of a circular loop as shown in FIG. 4A, a center fed rectangular loop, as shown in FIG. 4B, and an end fed rectangular loop, as shown in FIG. 4C. The measurements were made without a dielectric core. Table 1 A circular loop antenna 31 of the same area is used as a reference for the comparison. All antennas compared had the same cross-sectional area and were oriented in an electromagnetic field to maximize both E-field and H-field responses, as shown in FIG. 4A the H-field only or H dominant response as shown in FIG. 4B, and the E-field only or E dominant response as shown in FIG. 4C. As shown in FIG. 3, the circular loop antenna 31 response was as expected, having good H-dominant sensitivity, and poor E-dominant sensitivity. Also as expected, the combined E+H sensitivity reflected only the H dominant sensitivity. The E+H sensitivity of the end fed rectangular loop antenna was found to be 3.5 dB worse than the loop, while providing a similar E-field result. While the H dominant sensitivity was not measured, the combined E+H sensitivity measurement result is indicative of a poorer H dominant sensitivity. This result would be expected due to the higher resistance of the rectangular loop due to the length of the conductor compared to a circular loop of equivalent area. By comparison, the center fed rectangular loop 14 provided an E+H sensitivity 0.5 dB better than the circular loop, partly due to the substantially increased E-field sensitivity, even without the dielectric core. It is also important to note that the degradation of the H dominant sensitivity was significantly less than would otherwise be expected when compared to the results of the end fed rectangular loop.

Figure 5A:
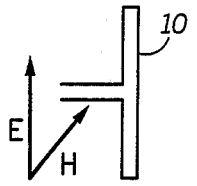
FIG. 5 is a table comparing the performance of the preferred embodiment of the present invention with and without a dielectric core.
Figure 5B:
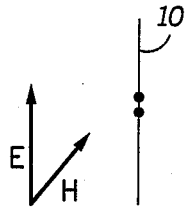
Figure 5C:
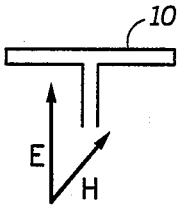

When dielectric core 16 is positioned within conductor 14, the electric dipole effect can be optimized, as previously explained. By properly selecting a dielectric material, the arms of the center fed rectangular loop can be made to perform as a one-half wavelength electric dipole at 280 MHz, the operating frequency of the preferred embodiment. Table 2 below tabulates the resultant sensitivities obtained by optimizing the electric dipole response. Table 2 The orientations of the center fed rectangular loop for measurement of the E+H, E-dominant and H-dominant field sensitivities are also shown in FIG. 4, allowing independent measurement of each of the sensitivities. By positioning antenna 10 vertically as shown in FIG. 5A, in a vertically polarized electromagnetic field, both the magnetic and electric dipoles are oriented to intercept the incident electromagnetic wave. As shown in Table 2, the measured E+H sensitivity is as shown, with a 1 dB improvement when the core is present in the antenna. Rotating antenna 10 ninety degrees as shown in FIG. 5B parallel, to the H-field places the antenna in the E-dominant position, results in a substantial 2.5 dB improvement in E-field sensitivity. By rotating antenna 10 into a horizontal position normal to the H-field, as shown in FIG. 5C, the H-dominant sensitivity is measured, and as shown, shows only a small, 0.5 dB, reduction in H-field sensitivity. It is also important to note the E-field and H-field sensitivities have been balanced due to the optimization of the electric dipole effect, and that the overall E+H sensitivity is 1.5 dB better than a circular loop of equivalent area.

While the preferred embodiment of the present invention described an antenna having an aspect ratio of the sides of 18 to 1, equivalent performance characteristics can be obtained for aspect ratios of 10 to 1 or greater. However, it will be appreciated, the lower the aspect ratio then the thicker the antenna profile. While a specific embodiment of this invention has been shown and described, further modifications and improvements will occur to those skilled in the art. All modifications which retain the basic underlying principles disclosed and claimed herein are within the scope and spirit of the present invention.

We claim:

1. An antenna for a thin portable communications receiver, comprising:

a conductor formed into single turn rectangular loop having a first set of two parallel opposed sides up to one-quarter wavelength in length at the operating frequency and a second set of two parallel opposed sides shorter than said first set of sides, said loop terminating in connection tabs, located symmetrically about the midpoint of one of said first set of sides, for connection to the receiver; and a dielectric core interposed within said loop and substantially filling said loop, with said dielectric core further forming a half-wave electric dipole symmetrical about said connection tabs at the operating frequency.

2. The antenna according to claim 1 wherein said conductor is flat sheet metal.

3. The antenna according to claim 2 wherein said metal sheet is beryllium copper.

4. The antenna according to claim 1 wherein said dielectric core has a substantially rectangular cross section normal to the plane of said loop.

5. The antenna according to claim 4 wherein the width of said dielectric core is at least the width of said conductor.

6. The antenna according to claim 1 wherein said dielectric core has a relative dielectric constant of from 3 to 250.

7. The antenna according to claim 1 wherein said predetermined operating frequency is greater than 150 MHz.

8. The antenna according to claim 1 wherein said antenna when operating in an incident electromagnetic wave has a predominantly magnetic field response normal to the received incident electromagnetic wave.

9. The antenna according to claim 1 wherein said antenna when operating in an incident electromagnetic wave has a predominantly electric field response parallel to the received incident electromagnetic wave.

10. The antenna according to claim 1 wherein the aspect ratio between said first set of parallel opposed sides and said second set of parallel opposed sides is at least 10 to 1.

11. The antenna according to claim 1, wherein said antenna is tuned to a center frequency and said center frequency is stable in the presence of a human body.

* * * * *